United States Patent [19]

Vecchia

[11] Patent Number: 4,875,260

[45] Date of Patent: Oct. 24, 1989

[54] APPARATUS FOR THE PRESETTABLE CALENDERING OF TUBULAR KNITTED FABRIC

[75] Inventor: Gino D. Vecchia, Santorso, Italy

[73] Assignee: Sperotto Rimar S.p.A., Zane, Italy

[21] Appl. No.: 63,172

[22] Filed: Jun. 17, 1987

[30] Foreign Application Priority Data

Jun. 17, 1986 [IT] Italy ..... 20812 A/86
Jun. 17, 1986 [IT] Italy ..... 22296 B/86
Nov. 28, 1986 [IT] Italy ..... 23886 B/86

[51] Int. Cl.[4] ..... D06C 5/00; D06C 25/00

[52] U.S. Cl. ..... 26/81; 26/84; 68/22 R

[58] Field of Search ..... 26/18.5, 81, 83, 84, 26/85; 68/22 R

[56] References Cited

U.S. PATENT DOCUMENTS 2,187,644 1/1940 Cohn et al. ..... 26/81 X
2,440,209 4/1948 Redman ..... 26/18.5 X
2,597,530 5/1952 Redman ..... 26/18.5
2,880,114 3/1959 Cohn et al. ..... 26/81 X
3,263,458 8/1966 Cohn et al. ..... 26/84 X
3,616,502 11/1971 Aronoff ..... 26/85
4,192,045 3/1980 Frezza ..... 26/84 X
4,269,046 5/1981 Strahm et al. ..... 26/85 X
4,335,593 6/1982 Strahm et al. ..... 26/85 X
4,541,156 9/1985 Walsh et al. ..... 26/81
4,628,712 12/1986 Strudel ..... 26/85 X

FOREIGN PATENT DOCUMENTS 426708 6/1967 Switzerland ..... 26/84
2059477 4/1981 United Kingdom ..... 26/84

*Primary Examiner*—Robert R. Mackey
*Attorney, Agent, or Firm*—Roberts, Spiecens & Cohen

[57] ABSTRACT

Equipment for the calendering of tubular knitted fabric (13) which, in the end step of a processing cycle, allows, by means of a cloth expander device (16), a steaming cxhamber (18) and a flattening, the width of the tubular fabric to be determined and fixed, besides giving the tubular fabric a commercially acceptable appearance. A plurality of calenders (19, 20, 26, 27) are disposed in series for being selectively used in engagement with the tubular knitted fabric (13) to effect a finishing treatment suitable for the individual type of tubular knitted fabric (13) which is undergoing treatment.

13 Claims, 2 Drawing Sheets

APPARATUS FOR THE PRESETTABLE CALENDERING OF TUBULAR KNITTED FABRIC

FIELD OF THE INVENTION

The present invention relates to a device for the presettable calendering of tubular knitted fabric.

BACKGROUND

The calendering of tubular knitted fabric is a finishing operation which is performed during the end stage of the processing cycle, and which has the purpose of drafting the tubular fabric, in general by means of a steaming and flattening between heated cylinders, after previously expanding and overfeeding it.

Such an operation allows the width of the tubular knitted fabric to be brought back to the required value, by determining the dimensions thereof, and allows the same tubular fabric to be given a commercially acceptable appearance and touch.

Normally, expander devices for the tubular knitted fabric are used, which are equipped with width adjustment systems, based on principles and elements of mechanical character, which require a manual intervention by the operator, and are, e.g., of the sliding-guide type, with blocking by means of screws; when it is necessary to act on the width control device inside the tubular knitted fabric, the textile finishing machine must be stopped.

It is evident that such a procedure causes time and production losses, an additional use of manpower, machine stoppage and cost increases, besides the undoubted difficulty of the intervention.

Furthermore, single machines or calenders of various types are used, which are different from each other essentially because of the usable cylinder types, as well as due to the different mechanical action they perform on the tubular knitted fabric. Thus, devices exist, which are equipped with drafting calenders, polishing calenders, friction calenders, and so forth.

The selection of the equipment to be used depends both on the type of tubular knitted fabric to be processed, e.g., determined by the different fibrous compositions and interlacing patterns of the knitted fabric, and on the finishing effect to be given, so that, according to the different cases, different calender types are used in sequence, which requires replacement of, the calender or equipment being used to be replaced.

The selection of the equipment is also a function of its installation in a processing line including downstream machines of different types, e.g., a dryer.

The case frequently occurs furthermore, in which the same article of tubular knitted fabric must be calendered with two different machines, and, hence, by two sequential passages, e.g., by first using a polishing calender equipped with a polished cylinder, and then a drafting calender, equipped with cylinders coated with a textile material.

Another problem which occurs frequently with some types of tubular knitted fabric, is in obtaining the required end width of the flattened tubular fabric by means of only one calendering passage. Namely, due to the deformations of the tubular knitted fabric during preceding wet-treatments, such as mercerization, bleaching, and/or dyeing, an excessive decrease in the original width is produced.

In such case, both the expansion and the overfeeding of the tubular knitted fabric must be performed gradually and progressively at least two sequential passages through the calendering machine.

It is evident that a double calendering passage, whatever the reasons requiring it may be, and whether it is carried out on the same calendering machine, or on two different calendering machines, causes a considerable decrease in productivity, higher than 50%, and a corresponding increase in production costs.

SUMMARY OF THE INVENTION

An object of the present invention is provide a system for solving all of these problems of calendering variety, of cylinder replacement and of related times for carrying it out, so as to reduce the costs of production and of machine engagement.

A further object is to provide a single, extremely flexible machine, easily adaptable to different knitted fabrics which must be calendered, and to different calendering treatments to be performed on the same knitted fabric. Furthermore, such equipment must be suitable for incorporation in a treatment facility, so as to reduce the production and machine servicing costs, the operating costs and the dead times due to material transport lags.

Still a further object of the present invention is to provide an expander device for tubular knitted fabric, which allows width control without stopping the machine, and which may even act during the processing, in an autonomous and continuous way, to correctly adjust the exact width of the tubular knitted fabric, without any manual interventions being necessary.

These and further objects are achieved, according to the present invention, by providing equipment for the calendering of tubular knitted fabric comprising, on a support frame, an expander device for the tubular knitted fabric being fed, a device for feeding the fabric towards a steaming chamber, and at least one pair of calendering cylinders for the fabric, characterized in that on said support frame a second pair of calendering cylinders is provided, installed sequentially with respect to said at least one pair of calendering cylinders.

Preferably, on said support frame, first and second calendering units are provided sequentially with both calendering units being provided with said second pair of calendering cylinders.

Preferably, said expander device for tubular knitted fabric is of the type comprising one pair of side expander elements provided on related support bars sliding relatively to each other, and adjustable in position, with an elastic element interposed between said expander elements, and is characterized in that said elastic element is a gas spring hinged to the two ends of said two support bars, and guide means are provided between the support bars for said pair of side expander elements for their mutual travel transversely of said tubular knitted fabric.

BRIEF DESCRIPTION OF THE DRAWING

Characteristics and advantages of a calendering device according to the present invention will be better understood from the following exemplifying and non-limitative disclosure, which refers to the attached schematic drawings, wherein.

DETAILED DESCRIPTION OF PREFERRED EMBODIMENTS

Figure 1:
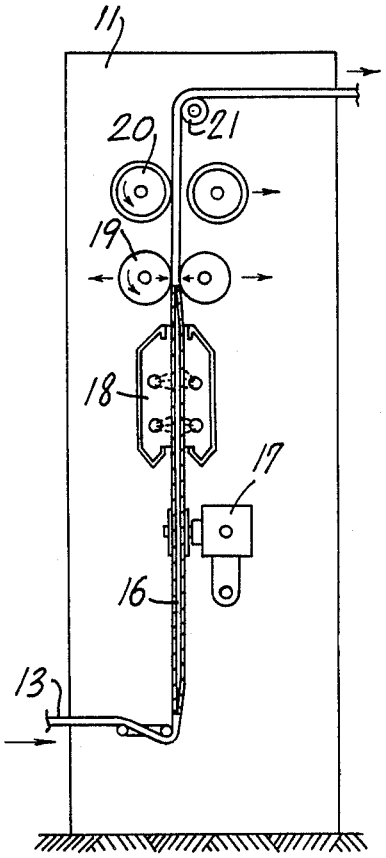
FIG. 1 is a schematic elevation view of a device according to the invention.

As it can be seen from FIG. 1, a calendering device comprises a support frame 11, suitable to be inserted, e.g., in a processing facility for tubular knitted fabric 13 which must be calendered, and is supplied with fabric 13, for example from a dryer outlet (not shown).

On said support frame 11, an expander device 16 is installed in a vertical position for expanding the tubular knitted fabric 13 which is then fed by a feeding device 17 to a steam chamber 18.

Downstream of said steam chamber 18, whereat the expander device 16 ends, there are provided, in sequence, a first pair of calendering cylinders 19, e.g., of the type with polished surface, and a second pair of calendering cylinders 20, e.g., of the type provided with a coating of a textile material.

On frame 11, at least one return roller 21 is positioned so to lead the tubular knitted fabric 13 towards the outlet, for supply to a collecting unit or a stacking machine.

In the disclosed embodiment, the first pair of calendering cylinders 19 is provided with a polished surface in engagement with the tubular knitted fabric as a function of the treated fabric type and of the calendering characteristics to be given.

When, either due to the use of a different type of processed fabric, or due to different end characteristics to be given to the fabric, it is sufficient to disengage the first pair of calendering cylinders 19, and engage the second pair of calendering cylinders 20 whose surfaces are provided with the coating of textile material, or the like.

Figure 2:
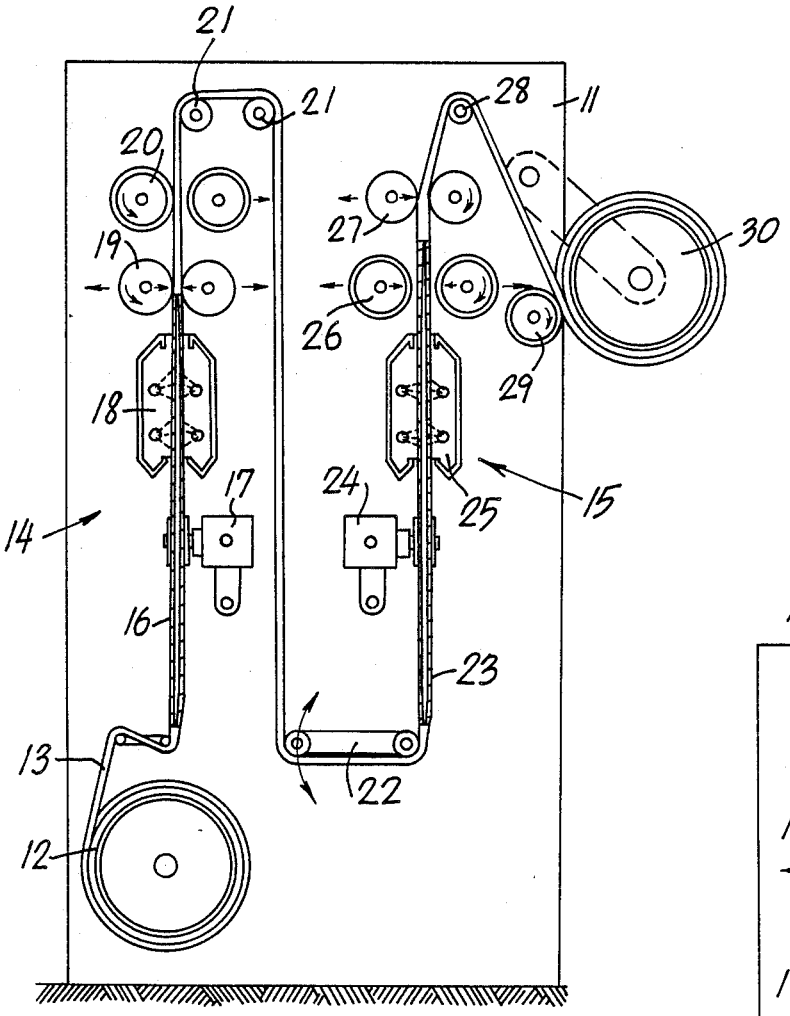
FIG. 2 is a schematic elevation view of a further device according to the invention.

According to the embodiment shown in FIG. 2, a reel 12 is mounted on support frame 11 for the tubular knitted fabric 13 to be calendered; alternatively, the fabric is supplied from a stack provided on a bench.

On support frame 11 there are provided, vertically, and substantially parallel to each other, both a first calendering unit, generally indicated by numeral 14, and similar to that shown in FIG. 1, and a second calendering unit, indicated by numeral 15.

In FIG. 2, the elements which constitute the first calendering unit are designated by the same reference numerals as in FIG. 1.

A set of return rollers 21, and a compensator element 22, e.g., of swinging type, which controls the tension of the tubular knitted fabric 13, are provided on the frame 11, so as to feed the tubular knitted fabric 13, are provided on the frame 11, so as to feed the tubular knitted fabric 13 to the second calendering unit 15.

The second calendering unit 15 is essentially composed of a set of components similar to those of the first calendering unit 14. Downstream of the compensator element 22, a further expanding device 23 is provided, which operates on the tubular knitted fabric 13 during its passage through both a further feeding device 24, and a further steaming chamber 25.

In sequence, a further first pair of calendering cylinders 26 and a further second pair of calendering cylinders 27 are provided. The first pair can be provided with a textile-material surface, and the second pair with a polished surface.

The tubular knitted fabric, after passing over a further return roller 28, is subsequently discharged by an outlet wind-up cylinder 29, which allows, and cooperates with, the winding up of the fabric on a wind-up reel 30, or delivers it to a stacking unit.

In the embodiment of FIG. 2, the first pair of calendering cylinders 19 and the further pair of calendering cylinders 27 are both of the polished-surface type. This however does not exclude the possibility that the various pairs of calendering cylinders can be constructed to act on the tubular knitted fabric in different combinations, so that different characteristics may be obtained in the calendered fabric, e.g., by using both of said pairs with cylinders of the type coated with a textile material, and/or selectively using first a pair with polished surfaces, and subsequently a pair with surfaces coated with textile material, and/or vice-versa.

This wide range of combinations, together with the possibility of variation of all of the other operating parameters, i.e., increase in operating speed of the feeding devices 17, 24 with over-feed, variation in steam volume in chambers 18, 25, allow many calendering effects to be obtained, so to fit a wide variety of fibers and weaving interlacing patterns.

It should be noted that functional changes in the operation of the equipment in FIGS. 1 and 2 is simply performed by means of the shifting, and the consequent engagement and disengagement of the various pairs of cylinders, in extremely short operating times, whereby production costs are considerably reduced.

A further very favorable advantage is that for one single calendering equipment only, it is possible to perform at least two different calendering operations in only one passage.

A further advantage is the elimination of cylinder replacements, or of the necessary presence of a plurality of different cylinder machines selectively insertable on line according to the requirements.

The positioning inside the equipment, in the reverse sequence, first of cylinders with surfaces coated with a textile material, and then of cylinders with polished surfaces, is within the scope of the present invention.

The calendering equipment according to the present invention as shown in FIG. 2 has the advantageous characteristics of allowing, on one single operating line, a double expansion and a double feed or progressive overfeed of the tubular knitted fabric.

Such an innovative operating concept enables the textile finisher to comply with many needs, and to solve at the same time the production and financial problems arising from the need for a plurality of sequential calendering passages.

Figure 3:
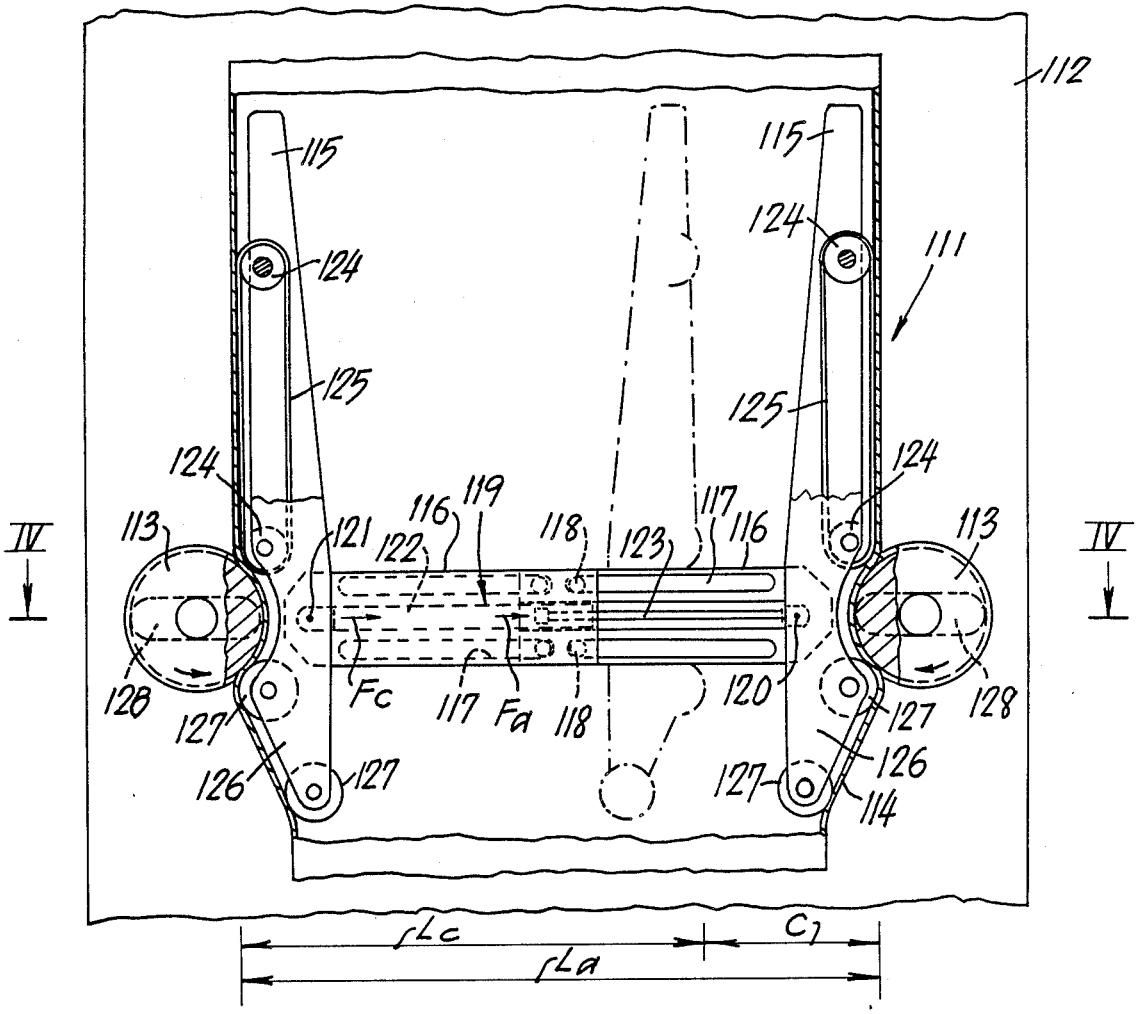
FIG. 3 shows an elevation view of an expander device according to the invention.
Figure 4:
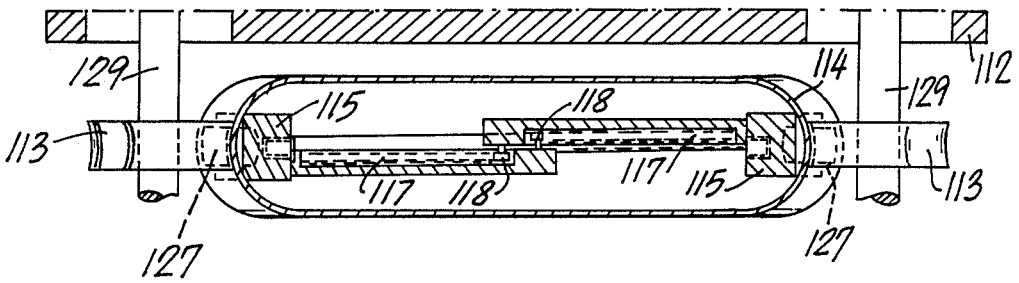
FIG. 4 is a sectional view taken along line IV—IV in FIG. 3.

Preferably, the expander device for tubular knitted fabric denoted at 16 or 23 in FIGS. 1 and 2 can be advantageously constructed as shown in FIGS. 3 and 4.

The expander device is generally designated by numeral 111 and is generally positioned on a support frame 112 of a textile finishing machine (not shown), between feed devices 113, e.g., motor-driven rollers, on which a tubular knitted fabric, schematically shown at 114, runs.

The expander device 111 is constituted by two side expander elements 115, each fixed-on a related support bar 116, with the two support bars 116 being slidable relative to each other.

Each support bar 116 has, on its side opposite the other bar, a pair of guide grooves 117 in which related guide rollers 118 are engaged, which are fixed to the opposite end portion of the other bar 116.

The two bars 116 can thus slide on each other, up to a maximum extended position, as shown in FIG. 3, of the right-hand expander element 115.

The two side expander elements 115, occupy a position of maximum width as indicated by La, and they can approach each other up to the position of minimum width, as indicated by Lc, the relevant stroke length being indicated by C.

An elastic element 119, such as a gas spring, has its ends hinged at 120 and 121 respectively to the two bars 116.

The gas spring 119, of known type, is constituted by a small cylinder 122 containing a pressurized gas, and a stem 123 which enters one of the two base ends of the cylinder. The two free and opposite ends of the cylinder 122 and of stem 123 are each fastened, as said, to its own bar 116, respectively at 121 and 120.

Each side expander element 115 supports two return wheels 124, slightly projecting from the element 115, on which a belt element 125 is wound for advancing the tubular knitted fabric. Furthermore, in correspondence with a lower inlet portion 126 of each side expander element 115, which has a shape convergent towards the interior of the device, two wheels 127 are furthermore provided, which cooperate to accompany the tubular knitted fabric 114 during the slipping thereof on the expander device 111 between the motor-driven wheels 113.

It should be observed that on the support frame 112, slots 128 may be provided, inside which the drive shafts 129 for the motor-driven rollers 113 can slide, so to allow the distance between the centers of the rollers to be modified, to adapt to varying widths of the tubular knitted fabric 114.

The operation of expander device 111 will explained hereafter.

In its working position, the expander device for the tubular knitted fabric is housed between the motor-driven wheels 113 of the finishing machine, in such a way that each of the wheels 113 abuts against the lower wheel 124 and the upper wheel 127.

The motor-driven wheels 113 can perform a lateral approaching or separating movement by sliding of their shafts 129 inside the slots 128.

When the two side expander elements 115 of the expander device are in their position of maximum width La, the stem 123 of the gas-spring 119 is in its extracted position from the cylinder 122, and the gas inside the cylinder exerts a thrust force Fa on the stem which applies the two side expander elements 115 against the motor-driven wheels 113.

Due to the transverse movement of the two motor-driven wheels 113 towards one another, the side expander elements 115 of the expander device progressively approach each other, causing the two bars 116 to slide on each other, with guidance by the guide rollers 118, thus compressing the gas spring 119 by retraction of stem 123 in the cylinder 122.

When the position of minimum width Lc is reached, the gas inside the cylinder 122 applies to the stem 123 a thrust force Fc, which keeps the side expanders 115 always against the motor-driven wheels 113 and allows them to follow the wheels, in the event of an opposite transverse movement, in the direction of opening of the tubular knitted fabric expander device.

The transverse movement of the motor-driven wheels 113 is electrically controlled by the operator attending the finishing machine, in accordance with the different fabric widths, thus causing the continuous and progressive opening and/or closure of the expander device 111, without any need for stopping the finishing machine, or for any manual interventions.

As compared to the width control devices known in the prior art, which use spiral springs or pneumatic pistons, the expander device of the invention has the following advantages:

the possibility of supplying an initial preload Fa, when the gas spring is in its released position, determined by the initial pressure of the gas contained inside the cylinder, thereby without affecting the useful length of stroke C;

very long useful stroke "C" of the gas spring, which reaches values as high as 40% of the length of the gas spring when this is in its released position, without causing any excessive increases in the thrust force, generally indicated by F;

change in the thrust force between the released position (Fa) and the compressed position (Fc) of the gas spring is limited to only 15–20%, which guarantees uniformity in the gas spring response, for all positions thereof; simplicity in structural, operative and application characteristics, with no need for connection to external power supplies, such as, compressed air.

What is claimed is:

1. Apparatus for calendering tubular knitted fabric comprising a support frame, means for feeding tubular knitted fabric in vertically upwards direction along said frame, expander means on said frame for stretching the tubular knitted fabric as the fabric is advanced along said frame, a steaming chamber on said frame above the expander means through which the stretched tubular fabric is fed, a first pair of calendering cylinders on said frame downstream of the steaming chamber for calendering the fabric after the fabric has left the steaming chamber, a second pair of calendering cylinders downstream of the first pair and through which the fabric is advanced, one of said pairs of calendering cylinders having polished surfaces and the other pair of calendering cylinders having a coating of textile material thereon for imparting different finishing effects to the tubular knitted fabric, and means for selectively engaging the pairs of rollers with the advancing fabric.

2. Apparatus for calendering tubular knitted fabric comprising a support frame, means for feeding tubular knitted fabric along said frame, expander means on said frame for stretching the tubular knitted fabric as the fabric is advanced along said frame, first and second calendering units on said support frame, each calendering unit including a steaming chamber on said frame through which the stretched tubular fabric is fed, a first pair of calendering cylinders on said frame for calendering the fabric after the fabric has left the steaming chamber, and a second pair of calendering cylinders downstream of the first pair and through which the fabric is advanced, the pairs of calendering cylinders in each unit having differing surface characteristics for imparting differing finishing effects to the tubular knitted fabric.

3. Apparatus as claimed in claim 2 wherein the first and second pairs of calendering cylinders in each unit are arranged vertically above one another, the two units being arranged parallel on said frame, said apparatus further comprising rollers between said units for guiding the travel of the fabric from one unit to the next and compensator means between said units for maintaining tension in said fabric.

4. Apparatus as claimed in claim 3 comprising a wind-up cylinder on said frame downstream of the second unit for advance of the fabric.

5. Apparatus as claimed in claim 4 comprising a wind-up reel adjacent to said wind-up cylinder for cooperating therewith to wind-up the fabric on said wind-up reel.

6. Apparatus as claimed in claim 2 wherein in each unit one of said pairs of calendering cylinders has polished surfaces and the other pair of calendering cylinders has a coating of textile material thereon.

7. Apparatus for calendering tubular knitted fabric comprising a support frame, means for feeding tubular knitted fabric along said frame, expander means on said frame for stretching the tubular knitted fabric as the fabric is advanced along said frame, a steaming chamber on said frame through which the stretched tubular fabric is fed, a first pair of calendering cylinders on said frame for calendering the fabric after the fabric has left the steaming chamber, and a second pair of calendering cylinders downstream of the first pair and through which the fabric is advanced, the first and second pairs of calendering cylinders having differing surface characteristics for imparting differing finishing effects to the tubular knitted fabric, said expander means comprising a pair of spaced expander elements on which the tubular fabric can advance while being stretched, respective support bars for said expander elements, said support bars extending transversely of the direction of advance of the fabric, said support bars being slidably arranged in transversely opposed relation to one another to adjustably overlap one another and vary the spacing between the expander elements with yielding force, and guide means for connecting said bars for relative slidable movement and for guiding said slidable movement of said support bars.

8. Apparatus as claimed in claim 7 wherein said guide means comprises a pair of guide rollers on each bar, said bars being provided with respective pairs of guide tracks in which the pairs of guide rollers on the opposed bars are slidably and guidably supported.

9. Apparatus as claimed in claim 7 comprising two guide wheels on each expander element and a belt wound on said guide wheels, said guide wheels and belt protruding outwards from the respective expander element.

10. Apparatus as claimed in claim 9 wherein said expander elements have lower ends at which the knitted fabric is introduced onto the expander elements, said expander elements having outer surfaces at said lower ends which diverge in the direction of travel of said knitted fabric.

11. Apparatus as claimed in claim 10 comprising rollers on said expander elements at the lower ends thereof for assisting the travel of the knitted fabric.

12. Apparatus as claimed in claim 11 further comprising driven wheels positioned on said support frame adjacent to individual ones of the guide wheels and rollers on the expander elements for drivingly advancing the fabric between the driven wheels and the guide wheels and rollers.

13. Apparatus as claimed in claim 12 comprising means supporting said driven wheels on said support frame for relative movement towards and away from one another as said expander elements undergo variation in spacing.

* * * * *